US009344814B2

(12) United States Patent
Rasmussen

(10) Patent No.: US 9,344,814 B2
(45) Date of Patent: May 17, 2016

(54) HEARING AID DEVICE AND METHOD FOR FEEDBACK REDUCTION

(71) Applicant: Oticon A/S, Smørum (DK)

(72) Inventor: Karsten Bo Rasmussen, Smørum (DK)

(73) Assignee: OTICON A/S, Smorum (DK)

( * ) Notice: Subject to any disclaimer, the term of this patent is extended or adjusted under 35 U.S.C. 154(b) by 0 days.

(21) Appl. No.: 14/338,540

(22) Filed: Jul. 23, 2014

(65) Prior Publication Data

US 2015/0043764 A1 Feb. 12, 2015

(30) Foreign Application Priority Data

Aug. 8, 2013 (EP) ..... 13179700

(51) Int. Cl.
*H04R 25/00* (2006.01)

(52) U.S. Cl.
CPC ..... *H04R 25/45* (2013.01); *H04R 25/353* (2013.01); *H04R 25/453* (2013.01); *H04R 25/356* (2013.01); *H04R 2225/023* (2013.01)

(58) Field of Classification Search
CPC ..... H04R 3/02; H04R 25/70; H04R 2225/41; H04R 25/505; H04R 2225/43; H04R 1/1083; H04R 25/353; H04R 25/305; H04R 25/558; H04R 2460/01; H04R 25/30; H04R 25/356; G10K 2210/3026; G10K 2210/506
USPC ..... 381/312, 316, 318, 320, 328, 83, 93, 381/108, 121, 60
See application file for complete search history.

(56) References Cited

U.S. PATENT DOCUMENTS

| | | | | |
|---|---|---|---|---|
| 6,097,823 | A * | 8/2000 | Kuo | G10K 11/1788 381/312 |
| 6,252,969 | B1 * | 6/2001 | Ando | H04R 3/02 381/103 |
| 7,512,245 | B2 * | 3/2009 | Rasmussen et al. | 381/110 |
| 7,756,276 | B2 * | 7/2010 | Hersbach | H04R 3/02 381/23.1 |
| 2002/0122563 | A1 | 9/2002 | Schumaier | |
| 2005/0271222 | A1 | 12/2005 | Freed et al. | |
| 2007/0009122 | A1 | 1/2007 | Hamacher | |
| 2008/0189107 | A1 * | 8/2008 | Laugesen | 704/233 |
| 2008/0205679 | A1 | 8/2008 | Darbut et al. | |
| 2009/0226016 | A1 * | 9/2009 | Fitz et al. | 381/316 |
| 2011/0300806 | A1 * | 12/2011 | Lindahl et al. | 455/63.1 |
| 2013/0108094 | A1 | 5/2013 | Pape et al. | |

FOREIGN PATENT DOCUMENTS

| | | | |
|---|---|---|---|
| EP | 1 480 494 | A2 | 11/2004 |
| EP | 1 744 589 | A2 | 1/2007 |
| EP | 2 249 587 | A2 | 11/2010 |
| WO | WO 90/05436 | A1 | 5/1990 |

* cited by examiner

*Primary Examiner* — Sunita Joshi
(74) *Attorney, Agent, or Firm* — Birch, Stewart, Kolasch & Birch, LLP

(57) ABSTRACT

A hearing aid device (2) is disclosed. The hearing aid device (2) is configured to be sealingly inserted into the bony region (20) of the ear canal (16). The hearing aid device (2) comprises a receiver (12) and at least one microphone (4, 6) and means for processing sound signals detected by the at least one microphone (4, 6). The hearing aid device (2) comprises means for carrying out electronic feedback suppression by applying a frequency shift (ΔF) and/or a time delay to the detected sound signals. A method for providing electronic feedback reduction in a hearing aid device (2) is also disclosed.

14 Claims, 3 Drawing Sheets

HEARING AID DEVICE AND METHOD FOR FEEDBACK REDUCTION

TECHNICAL FIELD

The present disclosure generally relates to a hearing aid device and a method to provide electronic feedback reduction. The disclosure more particularly relates to a hearing aid device, in which a so-called "bony seal" instrument such as a receiver is inserted in the ear canal and where an acoustic sealing is provided in the bony region of the ear canal. The disclosure also relates to a method for providing electronic feedback reduction in such hearing aid device.

BACKGROUND ART

It is known that hearing aid devices that are configured to provide bony seal provide an adequate sealing of the ear canal, and that this seal can preclude undesirable acoustic feedback. Several types of hearing aid devices are adapted to be fitted partly in a fleshy (cartilaginous) region and partly in a bony region of the ear canal in order to form a seal for the ear canal in the bony region of the ear canal.

Completely-in-the-canal (CIC) hearing aid devices and receiver-in-the-ear (RITE) hearing aid devices may be adapted for insertion into the bony region of the ear canal and hence these types of hearing aid devices may be capable of providing bony seal.

Even though bony seal is capable of reducing the quantity of undesirable acoustic feedback there is still need for further reduction of the acoustic feedback, especially in small hearing aid devices, in which the receiver and the microphone are arrange close to each other.

Bony seal hearing aid devices are either providing a complete or non-complete seal of the ear canal. When a complete seal is provided no ventilation occurs, however, when a non-complete seal is provided a vent is created in order to establish static pressure equalization between the small chamber between the hearing aid device and the ear drum and the surrounding atmosphere. In these types of bony seal hearing aid devices relative long time delays are acceptable without compromising on quality. In practice delay periods up to 10-20 ms could be used if the user should still be able to lip-read.

It is known to use frequency shift techniques in order to carry out electronic feedback reduction. It is also known that the frequency shift and the time delay of the processed sound signal are correlated and that the best electronic feedback reduction is associated with long time delays.

U.S. Pat. No. 6,097,823 A discloses a digital hearing aid that comprises a microphone, a control and modeling circuitry, and a receiver. The microphone receives an input sound signal and generates a digital input signal in response. The control and modeling circuitry filters and amplifies the digital input signal and performs feedback neutralization and feedback path modeling to generate a digital output signal. Hereafter the receiver receives the digital output signal and generates an output sound signal. This anti-feedback method applies time delay.

US2008205679 describes an in-ear auditory device having a receiver sized to fit within an ear canal of a user, a transducer and an isolator disposed to substantially acoustically isolate the transducer from the receiver. The auditory device is able to completely occlude the ear canal and having means for electronic feedback suppression.

US2002122563 describes a hearing aid for deep insertion where feedback is eliminated by electronically suppressing frequencies prone to generating feedback.

It is an object for the present disclosure to provide a method for electronic feedback reduction in a bony seal hearing aid device and to provide a bony seal hearing aid device having an improved electronic feedback reduction function.

Moreover, when the users own voice is active, the sound will travel by two paths: a) from the mouth to the air and into the hearing aid device and b) from bone/tissue conduction from the vocal organs to the hearing organs. Accordingly, interference between these two different signals gives rise to undesired sound quality issues.

Therefore, it is an object for the present disclosure to provide a "bony seal" hearing aid device, in which a high sound quality can be provided both when the voice of the user is active and inactive.

DISCLOSURE OF DISCLOSURE

The object of the present disclosure can be achieved by a hearing aid device as defined in claim 1 and by a method as defined in claim 11. Preferred embodiments are defined in the dependent sub claims and explained in the following description and illustrated in the accompanying drawings.

The hearing aid device according to the disclosure is a hearing aid device configured to be sealingly inserted into the bony region of the ear canal, which hearing aid device comprises a receiver and at least one microphone and means for processing sound signals detected by the at least one microphone. The hearing aid device comprises means for carrying out electronic feedback suppression by applying a frequency shift and/or a time delay to the sound signals detected by the at least one microphone.

Hereby a bony seal hearing aid device having an improved electronic feedback reduction function can be provided.

The hearing aid device may be any type of hearing aid device that can provide a bony sealing, including CIC hearing aid devices, RITE hearing aid devices, behind-the-ear (BTE) hearing aid devices having closed earpieces and invisible-in-canal (IIC) hearing aid devices.

The receiver may be any suitable receiver configured to be inserted in the ear canal. The bony seal may be provided by the receiver itself or by e.g. a dome attached to the receiver. The receiver may be housed in a housing constituting an ear mould capable of being sealingly inserted into the bony region of the ear canal.

The at least one microphone may be arranged in any suitable position on the hearing aid device allowing the at least one microphone to receive and detect sounds from the user's surroundings. The means for processing sound signals may be a processor chip arranged in a housing. The means for carrying out electronic feedback suppression may be a processor (e.g. a processor chip).

By the term "applying a frequency shift" is meant any suitable way of shifting the frequency of the detected sound signals in order to eliminate or suppress the undesirable acoustic feedback in a way in which an acceptable sound quality is provided to the user of the hearing aid. The acoustic feedback is generated when leakage of sound from the receiver is detected by the microphone.

By the term "applying a time delay" is meant any suitable way of providing a time delay to the detected sound signals in order to eliminate or suppress the undesirable acoustic feedback in a way in which an acceptable sound quality is provided to the user of the hearing aid.

It may be an advantage that the hearing aid device comprises means for setting individual time delay, frequency shift and amplification/gain parameters of the user of the hearing aid device and that the hearing aid device is configured to carry out electronic feedback suppression on the basis of the individual time delay, frequency shift and amplification/gain parameters.

Hereby it is possible to provide an electronic feedback suppression that matches the demand of the user of the hearing aid, and thus an optimum electronic feedback suppression can be achieved.

The parameters may be detected in any suitable way and the parameters may in principle depend on any suitable variable such as the frequency and sound level of the detected sound signals.

The setting of the parameters may be carried out by the dispenser by way of example.

It may be advantageous that the hearing aid device is configured to carry out frequency shift and/or time delay as function of the frequency of the detected sound signals.

Hereby it is achieved that different electronic feedback suppressions can be carried out in different frequency regions. This may be a huge advantage since hearing losses may be a function of frequency.

It may be beneficial that the frequency shift is defined by a first function in a first frequency region and that the frequency shift is defined by another function in a second frequency region and/or that the time delay is defined by a first function in the first frequency region and that the time delay is defined by another function in the second frequency region.

Hereby it is achieved that the electronic feedback suppression can be adjusted to specific frequency dependencies. Accordingly, it is possible to provide a complex and efficient electronic feedback suppression.

It may be an advantage that the frequency shift is defined by three or more functions in a corresponding number of frequency regions and/or that the time delay is defined by three or more functions in the frequency regions.

In this way it is possible to provide an even more complex and well-functioning electronic feedback suppression.

By way of example, in frequency regions where the gain/amplification needed in order to compensate for a particular hearing loss is low, the frequency shift can be very low or even zero, since the risk of feedback problems is small.

Similarly, the frequency shift may be increased in frequency regions where the gain or amplification needed in order to compensate for a particular hearing loss is high, provided that the frequency shift is inaudible or almost inaudible to the person in question.

Hence, by applying a frequency shift varying according to frequency region, the balance between risk of feedback and sound quality deterioration may be further optimized (e.g. optimized in the frequency domain) and may be adjusted taking the preferences and hearing properties of the individual hearing aid user into account.

A specific example is the case of lower frequencies such as below 1000 Hz where the average person is able to detect even small frequency shifts (for instance 10 Hz) but if a hearing impaired person is insensitive to such frequency shifts this may be exploited and a frequency shift of 10 Hz or more may be used thereby further reducing the risk of feedback. This is in particular relevant for power hearing aids where the gain/amplification is often low for high frequencies where no residual hearing exists and high for low frequencies where a considerable hearing impairment may be present.

It may be beneficial that the frequency shift is defined by one or more functions and/or that the time delay is defined by one or more functions that at least partly depends on the sound level of the detected sound signals and/or on the gain applied to the detected sound signals.

Hereby it is possible to use the sound level as input to carry out the electronic feedback suppression.

It may be advantageous that the hearing aid device is configured to detect the activity of the voice of the user of the hearing aid device. Hereby it is possible carry out a sophisticated electronic feedback suppression that takes the activity of the voice into account.

The activity of the voice of the user of the hearing aid device may be detected by any suitable method e.g. by means of an accelerometer. The detection of own voice activity in the hearing aid device may be detected by any other suitable method e.g. like disclosed in U.S. Pat. No. 7,512,245 B2.

It may be beneficial that the hearing aid device is configured to carry out electronic feedback suppression in a first mode when the voice of the user is active and in a different mode when the voice of the user is inactive.

Hereby it is possible to apply an electronic feedback suppression that takes into account whether or not the voice of the user of the hearing aid device is active.

It may be an advantage that a small frequency shift and/or a short time delay is applied when the voice of the user is active and that a longer delay time is applied when the voice of the user is inactive.

In this way the sound that travels through bone/tissue conduction from the vocal organs to the hearing organs basically corresponds to the processed sound. Moreover, a larger frequency shift and/or a longer delay time can be applied when the voice of the user is inactive. Accordingly, an improved electronic feedback suppression can be provided.

It may be beneficial that the applied frequency shift is within 5-50 Hz, preferably 10-30 Hz and/or that the applied time delay is 5-15 ms. These values are expected to generate an optimum electronic feedback suppression.

It may be an advantage that the hearing aid device comprises two or more microphones. The microphones may be used to detect voice activity or direction of a sound and hereby use this information while processing the detected sound signals.

The method according to the disclosure is a method for providing electronic feedback reduction in a hearing aid device configured to be sealingly inserted into the bony region of the ear canal, which hearing aid device comprises a receiver and at least one microphone and means for processing sound signals detected by the at least one microphone, characterised in that the method comprises the following steps:

- detecting the frequency of the detected sound signals; and
- carrying out electronic feedback suppression by applying a frequency shift and/or a time delay.

Hereby an improved method for electronic feedback reduction in a bony seal hearing aid device can be provided.

It may be beneficial that the method comprises the step of providing information about the hearing of the user of the hearing aid device and adjusting the settings of the hearing aid device on the basis of the information about the hearing of the user.

Hereby individually adjusted electronic feedback suppressions can be provided. Accordingly, the user of the hearing aid device achieves a better experience.

It may be an advantage that the method comprises the step of detecting the activity of the voice of the user of the hearing aid device. Hereby the method may take information about the activity of the voice of the user into account when performing the electronic feedback suppression.

It may be advantageous that the electronic feedback suppression is carried out in a first mode when the voice of the user of the hearing aid device is active, and that the electronic feedback suppression is carried out in different mode when the voice of the user of the hearing aid device is inactive.

It may be beneficial that a short time delay is applied when the voice of the user is active and that a longer time delay is applied when the voice of the user is inactive.

The hearing aid device and the method according to the disclosure takes advantage of the fact that frequency shift may vary from one frequency region to the next.

BRIEF DESCRIPTION OF THE DRAWINGS

The disclosure will become more fully understood from the detailed description given herein below. The accompanying drawings are given by way of illustration only, and thus, they are not limitative of the present disclosure. In the accompanying drawings:

FIG. 2 *b*) shows a schematic view of a CIC hearing aid according to the disclosure arranged in the bony region of the ear canal.

MODE(S) FOR CARRYING OUT THE DISCLOSURE

Figure 1:
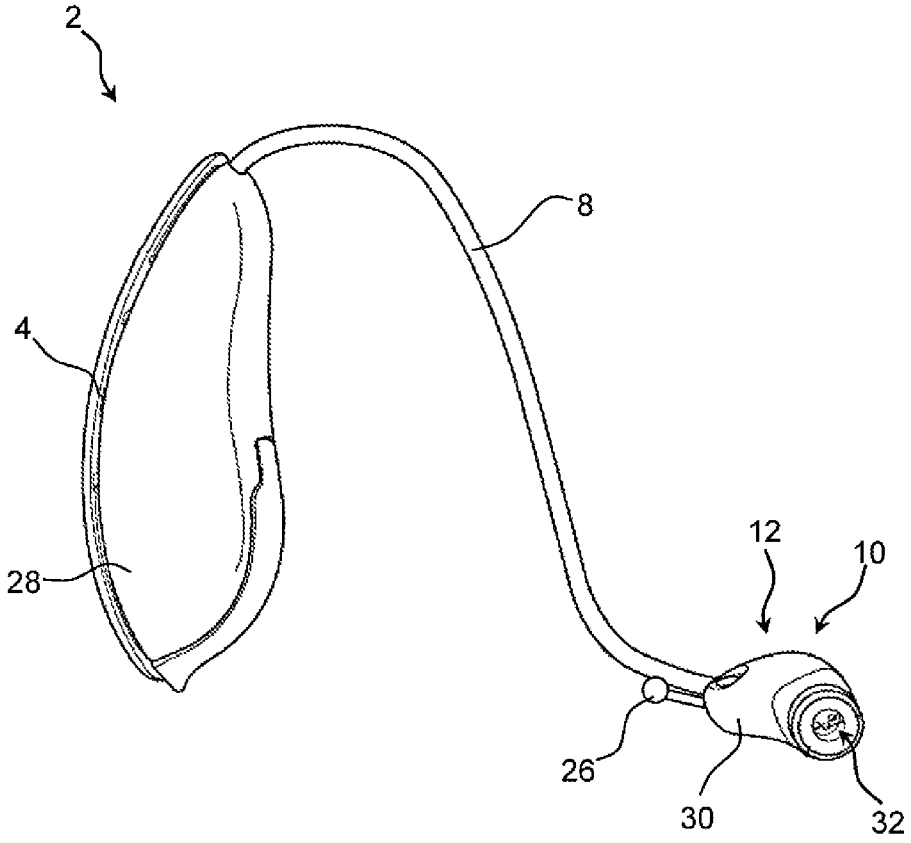
FIG. 1 shows a schematic perspective view of a RITE hearing aid according to the disclosure.

Referring now in detail to the drawings for the purpose of illustrating preferred embodiments of the present disclosure, a hearing aid device 2 according to the disclosure is illustrated in FIG. 1.

FIG. 1 illustrates a perspective view of a RITE hearing aid device 2 that comprises a housing 28 provided with first microphone 4. The housing 28 houses a battery (not shown), an amplifier (not shown) and a processing chip (not shown) configured to process the sounds picked up by the microphone 4 and send the processed sound to the amplifier.

The RITE hearing aid device 2 comprises an ear mould 10 comprising a receiver 12 and being configured to be sealingly inserted into the bony region of the ear canal (see FIG. 3) in order to provide an acoustic sealing (a bony seal).

The receiver 12 is comprised in a housing 30 provided with a sound outlet 32 at the distal end. At the proximal end of the housing 30 a pull-out string 26 is provided for assisting insertion and removal of the ear mould 10.

The housing 28 is electrically connected to the housing 30 of the ear mould 10 by means of a tube 8 comprising a plurality of electrical connectors through which the amplified sounds are sent to the receiver 12.

The sounds are transmitted by the receiver 12 into the inner ear where they are transformed into electrical impulses that are picked up by the brain, in which they are processed.

The hearing aid device 2 may comprise a second microphone (not shown) in order to be able to process the sound on the basis of directional information about the sound signals received by the first microphone 4 and by the additional microphone.

The hearing aid device 2 according to the disclosure is preferably configured to be individually adjusted e.g. by a dispenser, in such a manner that feedback is prevented in a smart individually adjusted way based on frequency shift and/or time delay techniques. The idea is to provide individual adjusted electronic feedback suppression by slightly shifting the frequency of the sound detected by the microphone 4 and/or to slightly delaying the detected sound signal.

For some users it may be beneficial to apply a large amplification in a specific frequency region (e.g. the range from 400 HZ to 700 Hz) and allow a rather long delay time (e.g. 15 ms) in the same frequency region.

For other users different settings may be advantageous. Accordingly, it is preferred that the hearing aid device 2 comprises means for being individually adjusted to the user of the hearing aid device 2 in a manner that allows for individually adjusted electronic feedback suppression.

The hearing aid device 2 according to the disclosure may also be a BTE hearing aid device with an earpiece connected to the BTE by a tube leading acoustic sound from a receiver 12 in the BTE part to the earpiece and thus to the ear drum.

It may be an advantage that the electronic feedback suppression is carried out by using at least two different modes representing; a) a mode in which the voice of the user of the hearing aid device 2 is active and b) a mode in which the voice of the user of the hearing aid device 2 is inactive.

It is preferred that a small frequency shift and/or a short time delay is applied when the voice of the user is active so that the sound that travels through bone/tissue conduction from the vocal organs to the hearing organs basically corresponds to the processed sound.

A larger frequency shift and/or a longer time delay can be applied when the voice of the user is inactive because of the bony seal.

Detection of the activity of the voice of the user of the hearing aid device may be carried out by means of a sensor member (not shown) that may comprise an accelerometer. The detection of own voice activity in the hearing aid device 2 may in principle be carried out by use of any suitable method e.g. like disclosed in U.S. Pat. No. 7,512,245 B2.

Figure 2:
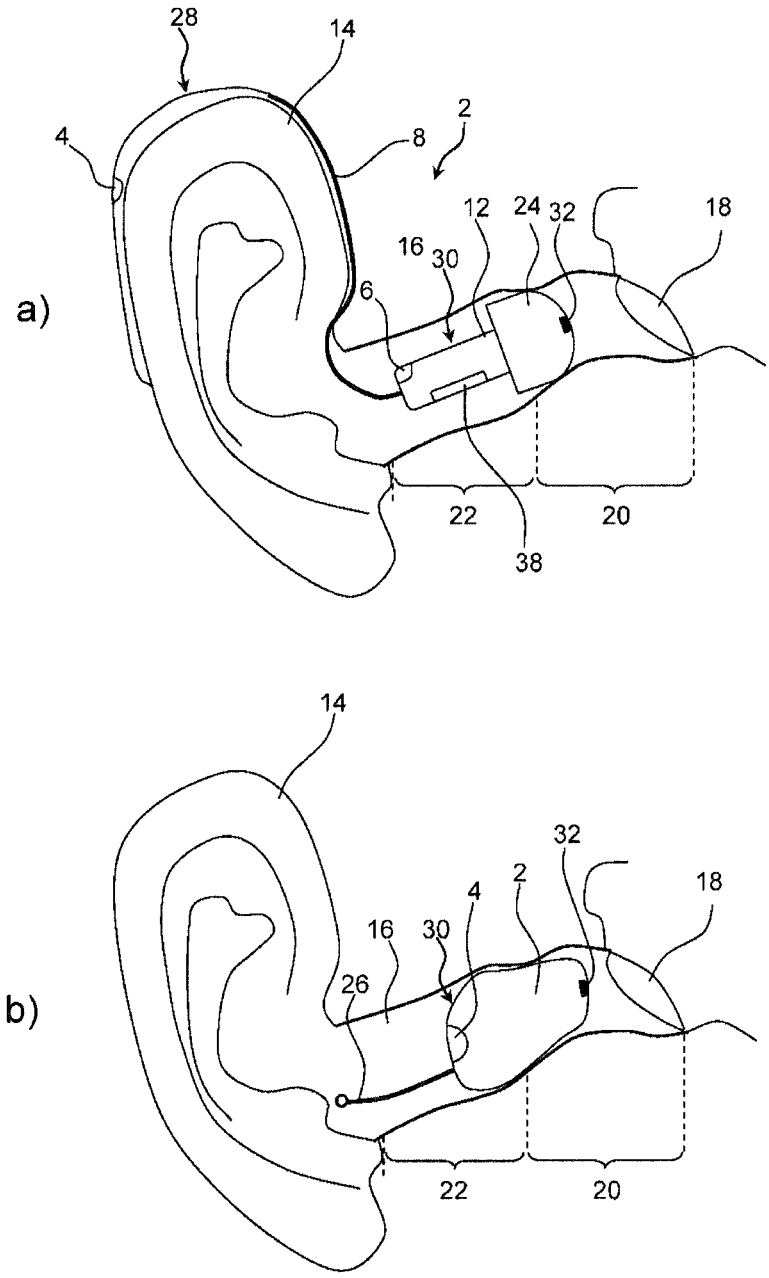
FIG. 2 *a*) shows a schematic view of a RITE hearing aid according to the disclosure, where the receiver is arranged in the bony region of the ear canal.

FIG. 2 *a*) illustrates a schematic cross-sectional view of a section of the head of the user of a hearing aid device 2 according to the disclosure. The hearing aid device 2 is a RITE hearing aid device 2 comprising a housing 28 that is arranged behind the ear 14 of the user of the hearing aid device 2. A first microphone 4 is provided in the housing 28.

The hearing aid device 2 moreover comprises a receiver 12 arranged in a housing 30 to which a dome 24 is mechanically attached. The dome 24 is sealingly arranged in the bony region 20 of the ear canal 16. The dome 24 is provided at the distal end of the housing 30 of the receiver 12. A sound outlet 32 is provided in the distal portion of the dome 24 that faces towards the ear drum 18.

The proximal portion of the receiver 12 extends into the cartilaginous region 22 of the ear canal 16 and a tube 8 connects the housing 28 with the housing 30 of the receiver 12. A second microphone 6 is provided at the proximal end of the receiver 12. Both sound input from the first microphone 4 and from the second microphone 6 is used to process the sound in order to provide the user of the hearing aid with an optimum sound experience.

Due to the bony seal established by sealingly arranging the dome 24 in the bony region 20 of the ear canal 16, it is possible to provide a complete seal of the ear canal so that relative long time delays (10-20 ms) are acceptable without compromising on quality of the sound.

The hearing aid device 2 is configured to apply a frequency shift and/or a time delay in order to carry out electronic feedback reduction like explained with reference to FIG. 1.

A sensor member 38 is provided at the receiver 12 and the sensor member 38 is configured to detect the activity of the voice of the user of the hearing aid device 2.

FIG. 2 *b*) illustrates a schematic cross-sectional view of a section of the head of the user of a hearing aid device 2 according to the disclosure. The hearing aid device 2 is a CIC hearing aid device 2 comprising a housing 30 comprising a microphone 4 and a receiver arranged in the housing 30. The housing 30 is sealingly arranged in the bony region 20 of the ear canal 16. A sound outlet 32 is provided in the distal portion of the housing 30 in close distance to the ear drum 18.

The proximal portion of the housing 30 extends along the cartilaginous region 22 of the ear canal 16. A pull-out string 26 is attached to the proximal portion of the housing 30. Even though not shown a second microphone may be provided in the housing 30.

Since the housing 30 of the hearing aid device 2 provides a bony seal while being sealingly arranged in the bony region 20 of the ear canal 16, it is possible to provide a complete seal of the ear canal 16, so that relative long time delays (10-20 ms) can be acceptable without compromising on quality of the sound.

The CIC hearing aid device 2 shown in FIG. 2 *b*) is configured to apply a frequency shift and/or a time delay with the purpose of providing an optimum electronic feedback reduction.

Even though not indicated, a sensor member may be provided at the housing for the purpose of detecting the activity of the voice of the user of the hearing aid device 2.

Figure 3:
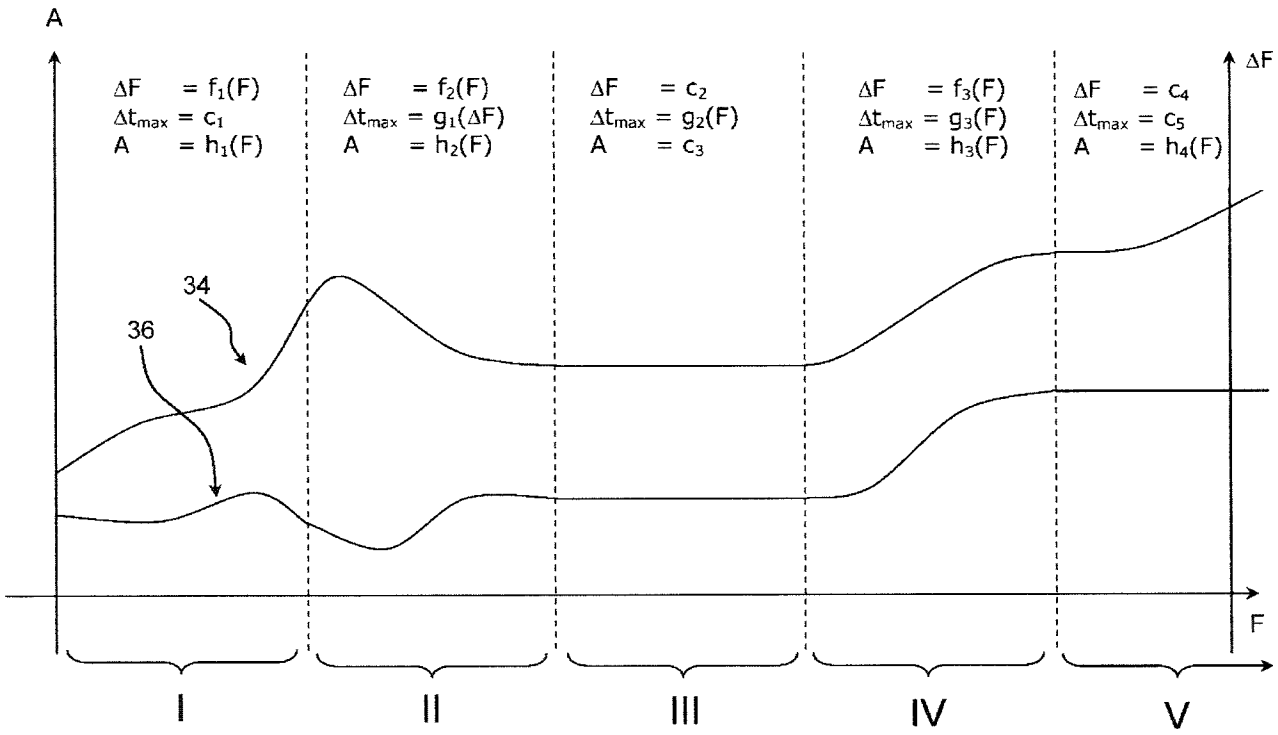
FIG. 3 shows an example of the individual frequency shift, time delay and amplification settings for a user of a hearing aid according to the disclosure.

FIG. 3 illustrates an example of the frequency shift, time delay and amplification settings for a user of a hearing aid 2 according to the disclosure. The example is illustrated by means of a first graph 34 showing the gain/amplification A as function of the frequency F of the sound detected by the microphone(s) of a hearing aid device according to the disclosure, and by means of a second graph 36 showing the frequency shift ΔF as function of the frequency F of the sound detected by the microphone(s).

The left ordinate shows the gain/amplification A, while the right ordinate shows the frequency shift ΔF.

Five frequency regions I, II, III, IV, V are indicated on the abscissa. In each of these frequency regions I, II, III, IV, V different settings are applied. This means that the processor within the hearing aid device is "programmed" to use these settings when the electronic feedback suppression is performed.

In the first frequency region I the frequency shift ΔF is a function $f_1$ of the frequency F, while the amplification A is another function $h_1$ of the frequency F. The maximum allowed time delay $\Delta t_{max}$ is given by a constant $c_1$.

When a hearing aid device according to the disclosure detects a sound within the first frequency region I, the settings defined above will be applied. In practice this means, that the processor will process the sound based on these restrictions/settings. However, it may be necessary to apply a lower frequency shift ΔF if the given functions $f_1$ and $h_1$ give rise to a too large time delay Δt. If this is the case, the processor may e.g. use a default setup to minimise the time delay Δt. A default setup may be a predefined reduction (e.g. 50%) of the function $f_1$ so that the new function is given by:

$$\Delta F = 0.5 f_1(F) \quad (1)$$

It is also possible to reduce the function $f_1$ with a constant like:

$$\Delta F = f_1(F) - 5 \text{ Hz} \quad (2)$$

Various other default setup procedures may be used to decrease the function $f_1$ in case the functions $f_1$ and $h_1$ give rise to a too large time delay Δt.

In the second frequency region II the frequency shift ΔF is a function $f_2$ of the frequency F, while the amplification A is another function $h_2$ of the frequency F. The maximum allowed time delay $\Delta t_{max}$ is given by a function $g_1$ of the calculated frequency shift ΔF. In this way it is possible to ensure that the maximum allowed time delay $\Delta t_{max}$ lies within an acceptable range even if a large frequency shift ΔF is calculated by using the function $f_2$.

In the third frequency region III the frequency shift ΔF is a constant $c_2$. The amplification A is a constant $c_3$ while the maximum allowed time delay $\Delta t_{max}$ is given by a function $g_2$ of the frequency F.

In the fourth frequency region IV the frequency shift ΔF is a function $f_3$ of the frequency F. The amplification A is a function $h_3$ of the frequency F, while the maximum allowed time delay $\Delta t_{max}$ is given by a function $g_3$ of the frequency F.

In the last and fifth frequency region V the frequency shift ΔF is a constant $c_4$, the amplification A is a function $h_4$ of the frequency F, while the maximum allowed time delay $\Delta t_{max}$ is a constant $c_5$.

The illustrated example is shown for illustration purpose and it may be beneficial to apply only one or few of the indicated setting principles.

The dispenser may carry out a comprehensive hearing evaluation and adjust the settings of a hearing aid device according to a predefined scheme on the basis of the hearing evaluation.

It is possible to provide a hearing aid device according to the disclosure with default settings corresponding to one or more specific groups e.g. first time users.

LIST OF REFERENCE NUMERALS

2 Hearing aid device
4 Microphone
6 Microphone
8 Tube with conductors
10 Ear mould
12 Receiver
14 Ear
16 Ear canal
18 Ear drum
20 Bony region
22 Cartilaginous region
24 Dome
26 Pull-out string
28 Housing
30 Housing
32 Sound outlet
Δt Time delay
$\Delta t_{max}$ Maximum time delay
ΔF Frequency shift
F Frequency
A Amplification/gain
34 Graph showing A as function of F
36 Graph showing ΔF as function of F
38 Sensor member
I, II, III, IV, V Frequency region
$f_1$, $f_2$, $f_3$, $g_1$, $g_2$, $g_3$ Function
$h_1$, $h_2$, $h_3$, $h_4$Function
$c_1$, $c_2$, $c_3$, $c_4$, $c_5$ Constant

The invention claimed is:

1. A hearing aid device configured to be sealingly inserted into the bony region of the ear canal, the hearing aid device comprising:

a receiver;

a microphone;

a processor configured to process sound signals detected by the microphone; and a feedback suppressor for carrying out electronic feedback suppression by applying at least one of a frequency shift and a time delay to the sound signals detected by the at least one microphone, wherein the hearing aid device is configured to set individual time delay, frequency shift and amplification parameters for the user of the hearing aid device, and the hearing aid device is configured to carry out electronic feedback suppression based on the individual time delay, the frequency shift, and the amplification parameters of the user of the hearing aid device.

2. The hearing aid device according to claim 1, wherein the hearing aid device is configured to carry out the at least one of the frequency shift and the time delay as function of the frequency of the detected sound signals.

3. The hearing aid device according claim 1, wherein the at least one of the frequency shift and the time delay is defined by one or more functions that at least partly depends on at least one of the sound level of the detected sound signals and the gain applied to the detected sound signals.

4. The hearing aid device according to claim 1, wherein the hearing aid device is configured to detect the activity of the voice of the user of the hearing aid device.

5. The hearing aid device according to claim 4, wherein the hearing aid device is configured to carry out electronic feedback suppression in a first mode when the voice of the user is active and in a different mode when the voice of the user is inactive.

6. The hearing aid device according to claim 4, wherein the feedback suppressor applies at least one of a small frequency shift and a short time delay when the voice of the user is active, and the feedback suppressor applies at least one of a larger frequency shift and a longer time delay when the voice of the user is inactive.

7. The hearing aid device according to claim 4, wherein the applied frequency shift is within 5-50 Hz and the applied time delay is 5-15 ms.

8. A method for providing electronic feedback reduction in a hearing aid device configured to be sealingly inserted into the bony region of the ear canal of a user, which hearing aid device comprises a receiver and at a microphone and a processor for processing sound signals detected by the microphone, wherein the method comprises:

detecting the frequency of the detected sound signals;

carrying out electronic feedback suppression by applying at least one of a frequency shift and a time delay;

setting an individual time delay for the user;

setting an amount of the frequency shift for the user; and setting amplification parameters for the user, wherein the electronic feedback suppression is carried out based on at least one of said individual time delay and said amount of frequency shift, and the amplification parameters for the user.

9. The method according to claim 8, further comprising:

detecting the activity of the voice of the user of the hearing aid device.

10. The method according to claim 9, wherein the electronic feedback suppression is carried out in a first mode when the voice of the user of the hearing aid device is active, and the electronic feedback suppression is carried out in a different mode when the voice of the user of the hearing aid device is inactive.

11. The method according to claim 10, wherein a short time delay is applied when the voice of the user is active and that a longer delay time is applied when the voice of the user is inactive.

12. The hearing aid according to claim 1, wherein in frequency regions where the amplification needed in order to compensate for the individual hearing loss is low, the frequency shift is very low or zero.

13. The hearing aid according to claim 1, wherein the frequency shift is large in frequency regions where the amplification needed in order to compensate for the individual hearing loss is high so that the frequency shift is inaudible or almost inaudible to the individual.

14. The hearing aid device according claim 1, wherein the applied frequency shift is within 5-50 Hz, and the applied time delay is 5-15 ms.

* * * * *